US010414016B2

(12) United States Patent
Takeda

(10) Patent No.: US 10,414,016 B2
(45) Date of Patent: Sep. 17, 2019

(54) CALIBRATION METHOD OF SUBSTRATE POLISHING APPARATUS, CALIBRATION APPARATUS OF THE SAME, AND NON-TRANSITORY COMPUTER READABLE RECORDING MEDIUM FOR RECORDING CALIBRATION PROGRAM OF THE SAME

(71) Applicant: Ebara Corporation, Tokyo (JP)

(72) Inventor: Koichi Takeda, Tokyo (JP)

(73) Assignee: Ebara Corporation, Tokyo (JP)

( * ) Notice: Subject to any disclaimer, the term of this patent is extended or adjusted under 35 U.S.C. 154(b) by 264 days.

(21) Appl. No.: 15/353,088

(22) Filed: Nov. 16, 2016

(65) Prior Publication Data

US 2017/0144265 A1 May 25, 2017

(30) Foreign Application Priority Data

Nov. 24, 2015 (JP) ..... 2015-228698

(51) Int. Cl.
*B24B 49/16* (2006.01)
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
CPC ..... B24B 49/16; B24B 49/00; B24B 37/20; B24B 37/005
USPC ..... 451/5, 8, 9, 10, 41, 287, 288, 289
See application file for complete search history.

(56) References Cited

U.S. PATENT DOCUMENTS 6,093,089 A * 7/2000 Chen ..... B24B 49/16 451/288
6,852,019 B2 * 2/2005 Togawa ..... B24B 41/061 451/288
6,857,947 B2 * 2/2005 Wang ..... B24B 21/04 451/288
6,899,607 B2 * 5/2005 Brown ..... B24B 1/005 257/E21.23
7,040,955 B1 * 5/2006 Kalenian ..... B24B 37/042 451/41

(Continued)

FOREIGN PATENT DOCUMENTS

JP 2002-134446 A 5/2002
JP 2005-081507 A 3/2005

(Continued)

OTHER PUBLICATIONS

Japan Patent Office, Notice of Reasons for Refusal in Japanese Patent Application No. 2015-228698 (Apr. 22, 2019) English.

*Primary Examiner* — Robert A Rose
(74) *Attorney, Agent, or Firm* — Leydig, Voit & Mayer, Ltd.

(57) ABSTRACT

According to one embodiment of the present disclosure, provided is a method of calibrating a relationship among a pressure command value, a pressure in an air-bag, and a pressure read value of the air-bag in a substrate polishing apparatus, the substrate polishing apparatus including: a polishing table; the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag.

9 Claims, 17 Drawing Sheets

(56) References Cited

U.S. PATENT DOCUMENTS

| | | | |
|---|---|---|---|
| 2005/0054266 | A1 | 3/2005 | Togawa |
| 2006/0009127 | A1 | 1/2006 | Sakurai et al. |
| 2014/0087629 | A1 | 3/2014 | Takahashi et al. |

FOREIGN PATENT DOCUMENTS

| | | | |
|---|---|---|---|
| JP | 2006-043873 | A | 2/2006 |
| JP | 2008-137103 | A | 6/2008 |
| JP | 2012-076157 | A | 4/2012 |
| JP | 2014-021881 | A | 2/2014 |

* cited by examiner

FIG.8A a = 0.25, b = 0

| | | | | | | |
|---|---|---|---|---|---|---|
| Pin | 0 | 400 | 800 | 1,200 | | 4,000 |
| Pms | 0 | 101 | 200 | 299 | | 999 |
| Pcalc=a*Pin+b | 0 | 100 | 200 | 300 | | 1,000 |

FIG.8B a = 0.25, b = 0

| Pin | 0 | 400 | 800 | 1,200 | | 4,000 |
|---|---|---|---|---|---|---|
| Pms | 150 | 228 | 311 | 390 | | 950 |
| Pcalc=a*Pin+b | 0 | 100 | 200 | 300 | | 1,000 |

FIG.9A c = 4, d = 0

| | | | | | | |
|---|---|---|---|---|---|---|
| Pms | 0 | 101 | 200 | 299 | | 999 |
| Prd | 0 | 401 | 800 | 1,196 | | 3,995 |
| Pcalc=a*Pms+d | 0 | 404 | 800 | 1,196 | | 3,996 |

FIG.9B c = 4, d = 0

| | | | | | | |
|---|---|---|---|---|---|---|
| Pms | 0 | 20 | 140 | 260 | | 1,100 |
| Prd | 333 | 400 | 795 | 1190 | | 3,960 |
| Pcalc=c*Pms+d | 0 | 80 | 560 | 1040 | | 4,400 |

CALIBRATION METHOD OF SUBSTRATE POLISHING APPARATUS, CALIBRATION APPARATUS OF THE SAME, AND NON-TRANSITORY COMPUTER READABLE RECORDING MEDIUM FOR RECORDING CALIBRATION PROGRAM OF THE SAME

CROSS-REFERENCE TO RELATED APPLICATIONS

This application claims the benefit of Japanese Priority Patent Application JP 2015-228698 filed on Nov. 24, 2015, the entire contents of which are incorporated herein by reference.

FIELD

The present technology relates to a calibration method of substrate polishing apparatus that polishes a substrate, a calibration apparatus of the same, and a non-transitory computer readable recording medium for recording calibration program of the same.

BACKGROUND AND SUMMARY

A substrate polishing apparatus holds a substrate with a top ring, and presses the substrate against a polishing pad, thereby polishing the substrate. The pressure to press the substrate against the polishing pad is variable, and can be adjusted with a pressure command value that is set from outside. However, the relationship between the pressure command value and the actual pressure is not always the same, and does change in some cases.

The substrate polishing apparatus also includes a dresser because the polishing rate decreases due to surface abrasion of the polishing pad. The dresser swings while in contact with the polishing pad. In this manner, the surface of the polishing pad is dressed (roughened). The load to be applied to the polishing pad by the dresser is also variable, and can also be adjusted with a load command value that is set from outside. However, the relationship between the load command value and the actual load is not always the same, and does change in some cases.

JP 2006-43873, JP 2012-76157, and others disclose technologies relating to substrate polishing apparatuses, but do not take the above aspects into account.

In view of the above, the relationship between the pressure command value and the actual pressure, and the relationship between the load command value and the actual load need to be calibrated when the substrate polishing apparatus is activated or when expendable supplies are replaced. Performing such calibration and checking results of the calibration put an extra load on an operator, and hinder the operator from carrying out other tasks.

The present technology has been developed in view of the above problems, and aims to provide a calibration method of substrate polishing apparatus that polishes a substrate, a calibration apparatus of the same, and a non-transitory computer readable recording medium for recording calibration program of the same for efficiently calibrating a substrate polishing apparatus in a simple manner, a calibration apparatus, and a computer-readable recording medium storing a calibration program.

According to one embodiment, provided is a method of calibrating a relationship among a pressure command value, a pressure in an air-bag, and a pressure read value of the air-bag in a substrate polishing apparatus, the substrate polishing apparatus comprising: a polishing table; the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag, the method comprising: sequentially inputting a plurality of pressure command values to the pressure control unit; acquiring a pressure measurement value of the air-bag with respect to each of the pressure command values, the pressure measurement value being measured by a pressure meter for calibration; acquiring, from the pressure control unit, a pressure read value of the air-bag with respect to each of the pressure command values; and determining a first parameter and a second parameter, the first parameter indicating a relationship between the pressure command value and the pressure measurement value, and the second parameter indicating a relationship between the pressure measurement value and the pressure read value.

According to another embodiment, provided is a calibration apparatus that calibrates a relationship among a pressure command value, a pressure in an air-bag, and a pressure read value of the air-bag in a substrate polishing apparatus, the substrate polishing apparatus comprising: a polishing table; the air-bag configured to press a substrate against the polishing table, the pressure for pressing the substrate being variable; and a pressure control unit configured to control the pressure in the air-bag in accordance with the pressure command value input to the pressure control unit, and read the pressure in the air-bag, the calibration apparatus comprising: a command value input unit configured to sequentially input a plurality of pressure command values to the pressure control unit; a measurement value acquiring unit configured to acquire a pressure measurement value of the air-bag with respect to each of the pressure command values, the pressure measurement value being measured by a pressure meter for calibration; a read value acquiring unit configured to acquire, from the pressure control unit, a pressure read value of the air-bag with respect to each of the pressure command values; and a parameter control unit configured to determine a first parameter and a second parameter, the first parameter indicating a relationship between the pressure command value and the pressure measurement value, and the second parameter indicating a relationship between the pressure measurement value and the pressure read value.

According to another embodiment, provided is a non-transitory computer readable recording medium for recording a calibration program of calibrating a relationship among a pressure command value, a pressure in an air-bag, and a pressure read value of the air-bag in a substrate polishing apparatus, the substrate polishing apparatus comprising: a polishing table; the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag, the calibration program causing a computer to execute: sequentially inputting a plurality of pressure command values to the pressure control unit; acquiring a pressure measurement value of the air-bag with respect to each of the pressure command values, the pressure measurement value being measured by a pressure meter for calibration; acquiring, from the pressure control unit, a pressure read value of the air-bag with respect to each of the pressure command values; and determining a first parameter and a second parameter, the first parameter indicating a relationship between the pressure command value and the pressure measurement value, and the second parameter indicating a relationship between the pressure measurement value and the pressure read value.

According to another embodiment, provided a method of calibrating a relationship among a load command value, a load on a dresser, and a load read value of the dresser in a substrate polishing apparatus, the substrate polishing apparatus comprising: a polishing table configured to polish a substrate; the dresser configured to dress the polishing table, a load on the polishing table being variable; and a load control unit configured to control the load on the dresser in accordance with the load command value inputted to the load control unit, and read the load on the dresser, the method comprising: sequentially inputting a plurality of load command values to the load control unit; acquiring a load measurement value of the dresser with respect to each of the load command values, the load measurement value being measured by a load meter for calibration; acquiring, from the load control unit, a load read value of the dresser with respect to each of the load command values; and determining a first parameter and a second parameter, the first parameter indicating a relationship between the load command value and the load measurement value, and the second parameter indicating a relationship between the load measurement value and the load read value.

According to another embodiment, provided a calibration apparatus that calibrates a relationship among a load command value, a load on a dresser, and a load read value of the dresser in a substrate polishing apparatus, the substrate polishing apparatus comprising: a polishing table configured to polish a substrate; the dresser configured to dress the polishing table, a load on the polishing table being variable; and a load control unit configured to control the load on the dresser in accordance with the load command value inputted to the load control unit, and read the load on the dresser, the calibration apparatus comprising: a command value input unit configured to sequentially input a plurality of load command values to the load control unit; a measurement value acquiring unit configured to acquire a load measurement value of the dresser with respect to each of the load command values, the load measurement value being measured by a load meter for calibration; a read value acquiring unit configured to acquire, from the load control unit, a load read value of the dresser with respect to each of the load command values; and a parameter control unit configured to determine a first parameter and a second parameter, the first parameter indicating a relationship between the load command value and the load measurement value, and the second parameter indicating a relationship between the load measurement value and the load read value.

According to another embodiment, provided a non-transitory computer readable recording medium for recording a calibration program of calibrating a relationship among a load command value, a load on a dresser, and a load read value of the dresser in a substrate polishing apparatus, the substrate polishing apparatus comprising: a polishing table configured to polish a substrate; the dresser configured to dress the polishing table, a load on the polishing table being variable; and a load control unit configured to control the load on the dresser in accordance with the load command value inputted to the load control unit, and read the load on the dresser, the calibration program causing a computer to execute: sequentially inputting a plurality of load command values to the load control unit; acquiring a load measurement value of the dresser with respect to each of the load command values, the load measurement value being measured by a load meter for calibration; acquiring, from the load control unit, a load read value of the dresser with respect to each of the load command values; and determining a first parameter and a second parameter, the first parameter indicating a relationship between the load command value and the load measurement value, and the second parameter indicating a relationship between the load measurement value and the load read value.

BRIEF DESCRIPTION OF DRAWINGS

FIGS. 8A and 8B are tables for explaining error determination for D/A parameters;

FIGS. 9A and 9B are tables for explaining error determination for A/D parameters;

DETAILED DESCRIPTION

Figure 1:
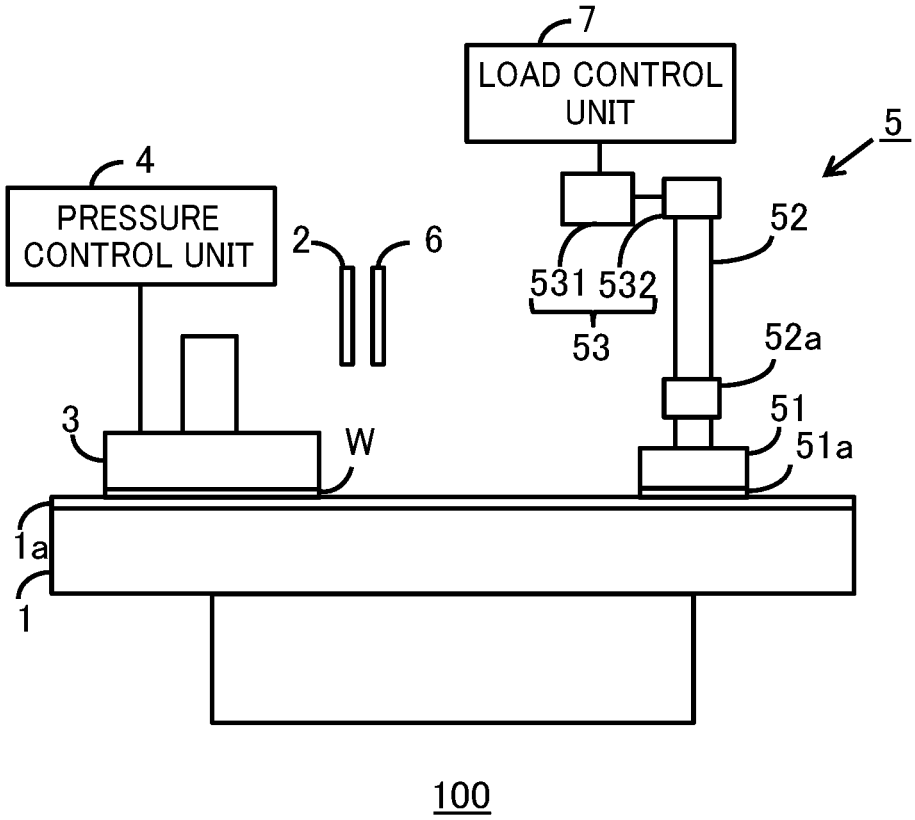
FIG. 1 is a diagram schematically showing a substrate polishing apparatus.

The following is a description of embodiments. It should be noted that the embodiments described below are an example case where the present technology is embodied, and does not limit the present technology to the specific structures described below. In embodying the present technology, any appropriate specific structure according to an embodiment may be employed.

According to one embodiment of the present disclosure, provided is a method of calibrating a relationship among a pressure command value, a pressure in an air-bag, and a pressure read value of the air-bag in a substrate polishing apparatus, the substrate polishing apparatus comprising: a polishing table; the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag, the method comprising: sequentially inputting a plurality of pressure command values to the pressure control unit; acquiring a pressure measurement value of the air-bag with respect to each of the pressure command values, the pressure measurement value being measured by a pressure meter for calibration; acquiring, from the pressure control unit, a pressure read value of the air-bag with respect to each of the pressure command values; and determining a first parameter and a second parameter, the first parameter indicating a relationship between the pressure command value and the pressure measurement value, and the second parameter indicating a relationship between the pressure measurement value and the pressure read value.

With this configuration, the tasks the operator needs to carryout can be reduced, and the substrate polishing apparatus can be efficiently calibrated in a simple manner.

Preferably, the method further comprises determining, after the pressure command value is input to the pressure control unit, whether there is leakage from the air-bag.

With this configuration, leakage from an air-bag can be detected during calibration.

In the method, determining whether there is leakage from the air-bag may comprise: determining whether the pressure in the air-bag has stabilized; and determining that there is leakage from the air-bag when the pressure in the air-bag does not stabilize over a predetermined period of time.

With this configuration, leakage from an air-bag can be accurately detected in a case where the pressure in the air-bag does not stabilize over a long time.

In the method, determining whether there is leakage from the air-bag may comprise: determining whether the pressure in the air-bag has stabilized; and determining that there is leakage from the air-bag when a rate of flow into or from the air-bag exceeds a first value after the pressure in the air-bag has stabilized.

With this configuration, the likelihood of leakage is high in a case where the pressure stabilizes as air is continuously sent into the air-bag, and such leakage can be accurately detected.

In the method, determining whether the pressure in the air-bag has stabilized may be carried out after a first period of time has passed since the pressure control unit started controlling the pressure in the air-bag in accordance with the pressure command value.

With this configuration, the accuracy in pressure stabilization determination can be increased, as the pressure stabilization determination is not performed immediately after the start of pressure control.

In the method, determining whether the pressure in the air-bag has stabilized may comprise; acquiring the pressure read value for a first period of time, and determining whether the pressure has stabilized in accordance with a difference between a largest value of the pressure read value and a smallest value of the pressure read value during the first period of time.

In the method, after the first parameter and the second parameter are generated, inputting the plurality of pressure command values, acquiring the pressure measurement value and acquiring the pressure read value are carried out; and the method further comprises checking whether a first relationship among the pressure command value, the pressure measurement value and the generated first parameter is appropriate, and checking whether a second relationship among the pressure measurement value, the pressure read value and the generated second parameter is appropriate.

With this configuration, the repetitive accuracy of the first parameter and the second parameter can be checked.

According to another embodiment of the present disclosure, provided is a calibration apparatus that calibrates a relationship among a pressure command value, a pressure in an air-bag, and a pressure read value of the air-bag in a substrate polishing apparatus, the substrate polishing apparatus comprising: a polishing table; the air-bag configured to press a substrate against the polishing table, the pressure for pressing the substrate being variable; and a pressure control unit configured to control the pressure in the air-bag in accordance with the pressure command value input to the pressure control unit, and read the pressure in the air-bag, the calibration apparatus comprising: a command value input unit configured to sequentially input a plurality of pressure command values to the pressure control unit; a measurement value acquiring unit configured to acquire a pressure measurement value of the air-bag with respect to each of the pressure command values, the pressure measurement value being measured by a pressure meter for calibration; a read value acquiring unit configured to acquire, from the pressure control unit, a pressure read value of the air-bag with respect to each of the pressure command values; and a parameter control unit configured to determine a first parameter and a second parameter, the first parameter indicating a relationship between the pressure command value and the pressure measurement value, and the second parameter indicating a relationship between the pressure measurement value and the pressure read value According to another embodiment of the present disclosure, provided is a non-transitory computer readable recording medium for recording a calibration program of calibrating a relationship among a pressure command value, a pressure in an air-bag, and a pressure read value of the air-bag in a substrate polishing apparatus, the substrate polishing apparatus comprising: a polishing table; the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag, the calibration program causing a computer to execute: sequentially inputting a plurality of pressure command values to the pressure control unit; acquiring a pressure measurement value of the air-bag with respect to each of the pressure command values, the pressure measurement value being measured by a pressure meter for calibration; acquiring, from the pressure control unit, a pressure read value of the air-bag with respect to each of the pressure command values; and determining a first parameter and a second parameter, the first parameter indicating a relationship between the pressure command value and the pressure measurement value, and the second parameter indicating a relationship between the pressure measurement value and the pressure read value.

According to another embodiment of the present disclosure, provided is a method of calibrating a relationship among a load command value, a load on a dresser, and a load read value of the dresser in a substrate polishing apparatus, the substrate polishing apparatus comprising: a polishing table configured to polish a substrate; the dresser configured to dress the polishing table, a load on the polishing table being variable; and a load control unit configured to control the load on the dresser in accordance with the load command value inputted to the load control unit, and read the load on the dresser, the method comprising: sequentially inputting a plurality of load command values to the load control unit; acquiring a load measurement value of the dresser with respect to each of the load command values, the load measurement value being measured by a load meter for calibration; acquiring, from the load control unit, a load read value of the dresser with respect to each of the load command values; and determining a first parameter and a second parameter, the first parameter indicating a relationship between the load command value and the load measurement value, and the second parameter indicating a relationship between the load measurement value and the load read value.

With this configuration, the tasks the operator needs to carryout can be reduced, and the substrate polishing apparatus can be efficiently calibrated in a simple manner.

According to another embodiment of the present disclosure, provided is a calibration apparatus that calibrates a relationship among a load command value, a load on a dresser, and a load read value of the dresser in a substrate polishing apparatus, the substrate polishing apparatus comprising: a polishing table configured to polish a substrate; the dresser configured to dress the polishing table, a load on the polishing table being variable; and a load control unit configured to control the load on the dresser in accordance with the load command value inputted to the load control unit, and read the load on the dresser, the calibration apparatus comprising: a command value input unit configured to sequentially input a plurality of load command values to the load control unit; a measurement value acquiring unit configured to acquire a load measurement value of the dresser with respect to each of the load command values, the load measurement value being measured by a load meter for calibration; a read value acquiring unit configured to acquire, from the load control unit, a load read value of the dresser with respect to each of the load command values; and a parameter control unit configured to determine a first parameter and a second parameter, the first parameter indicating a relationship between the load command value and the load measurement value, and the second parameter indicating a relationship between the load measurement value and the load read value.

According to another embodiment of the present disclosure, provided is a non-transitory computer readable recording medium for recording a calibration program of calibrating a relationship among a load command value, a load on a dresser, and a load read value of the dresser in a substrate polishing apparatus, the substrate polishing apparatus comprising: a polishing table configured to polish a substrate; the dresser configured to dress the polishing table, a load on the polishing table being variable; and a load control unit configured to control the load on the dresser in accordance with the load command value inputted to the load control unit, and read the load on the dresser, the calibration program causing a computer to execute: sequentially inputting a plurality of load command values to the load control unit; acquiring a load measurement value of the dresser with respect to each of the load command values, the load measurement value being measured by a load meter for calibration; acquiring, from the load control unit, a load read value of the dresser with respect to each of the load command values; and determining a first parameter and a second parameter, the first parameter indicating a relationship between the load command value and the load measurement value, and the second parameter indicating a relationship between the load measurement value and the load read value.

The following is a detailed description of embodiments of the present invention, with reference to the accompanying drawings.

First Embodiment

FIG. 1 is a diagram schematically showing a substrate polishing apparatus 100. The substrate polishing apparatus 100 is designed for polishing substrates W that are semiconductor wafers or the like. The substrate polishing apparatus 100 includes: a polishing table 1 having a polishing pad 1*a* attached to the surface thereof; a polishing liquid supply nozzle 2 that supplies a polishing liquid (slurry, for example) at the time of substrate polishing; a top ring 3 that holds the substrate W and presses the substrate W against the polishing pad 1*a*; and a pressure control unit 4.

A substrate W is polished in the following manner. As a polishing liquid is supplied from the polishing liquid supply nozzle 2 onto the polishing pad 1*a*, the top ring 3 holding the substrate W is lowered. The substrate W is then pressed against the upper surface of the polishing pad 1*a* while the top ring 3 and the polishing table 1 are rotated. The pressure to be applied to the substrate W is controlled by the pressure control unit 4. The substrate W and the polishing pad 1*a* are rubbed against each other in the presence of the polishing liquid. Thus, the surface of the substrate W is polished and smoothed.

After a large number of substrates W are polished, the surface of the polishing pad 1*a* becomes worn. To counter this, the substrate polishing apparatus 100 includes a dressing unit 5 for dressing (roughening) the surface of the polishing pad 1*a*, a dressing liquid supply nozzle 6, and a load control unit 7. These components will be explained later in the description of a fourth embodiment.

Figure 2:
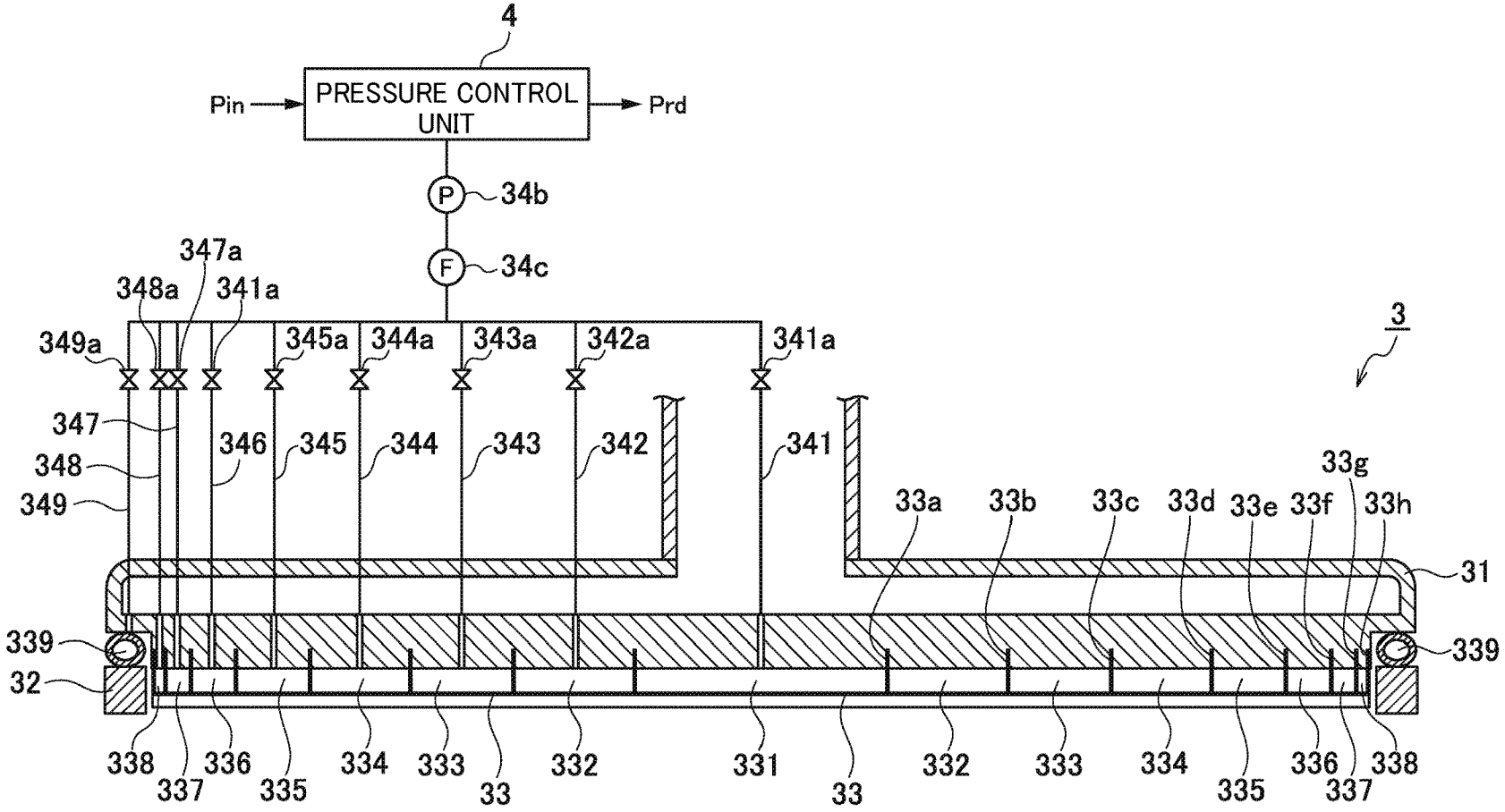
FIG. 2 is a schematic cross-sectional view of a top ring.

FIG. 2 is a schematic cross-sectional view of the top ring 3. The top ring 3 includes a top ring main body 31, an annular retainer ring 32, and a flexible membrane 33 (an elastic film) provided below the top ring main body 31.

Circumferential walls 33*a* through 33*h* extending toward the top ring main body 31 are formed concentrically on the membrane 33. As these circumferential walls 33*a* through 33*h* are provided, eight concentric areas 331 through 338 divided by the circumferential walls 33*a* through 33*h* are formed between the upper surface of the membrane 33 and the lower surface of the top ring main body 31.

Also, pipes 341 through 348 that penetrate through the top ring main body 31 and reach the areas 331 through 338, respectively, are formed. A retainer chamber 339 formed with an elastic film is provided immediately above the retainer ring 32, and a pipe 349 reaching the retainer chamber 339 is formed as well. The pipes 341 through 349 are connected to the pressure control unit 4 via valves 341*a* through 349*a*, a pressure meter 34*b*, and a flowmeter 34*c*, and the pressures in the areas 331 through 338 and the retainer chamber 339 are controlled.

As the areas 331 through 338 are depressurized, the substrate adsorbs and sticks to the membrane 33. Utilizing this, the top ring 3 can receive the substrate from a conveying device (not shown). When the substrate is transferred, the retainer chamber 339 is depressurized, to lift up the retainer ring 32.

When the substrate is polished, the top ring 3 is lowered, and the lower surface of the substrate is brought into contact with the upper surface of the polishing pad 1*a*. As the areas 331 through 338 are pressurized in this situation, the substrate is pressed against the upper surface of the polishing pad 1*a*. It should be noted that, when the substrate is polished, the retainer chamber 339 is pressurized to lower the retainer ring 32, so that the substrate will not protrude from the top ring.

Hereinafter, the areas 331 through 338 will be referred to as the air-bags 331 through 338. Next, pressure control on the air-bag 331, as a typical example, will be described in detail. In a case where the pressure in the air-bag 331 is controlled, only the valve 341*a* is opened, and the valves 342*a* through 349*a* remain closed. This enables the pressure control unit 4 to control the pressure in the air-bag 331. Also, the pressure meter 34*b* is enabled to measure the pressure in the air-bag 331, and the flowmeter 34*c* is enabled to measure the rate of flow into/from the air-bag 331.

A pressure command value Pin is input to the pressure control unit 4 from outside so as to control the pressure. In accordance with the pressure command value Pin, the pressure control unit 4 sends air into or sucks air from the air-bag 331, to control the pressure in the air-bag 331. In this embodiment, as an example, the pressure command value Pin is a digital value from 0 to 4000. The pressure command value Pin corresponds to the target pressure in the air-bag 331 linearly.

The pressure control unit 4 also reads the value of the pressure meter 34*b*, and outputs the value as a pressure read value Prd. The pressure read value Prd is also a digital value from 0 to 4000. The pressure read value Prd corresponds to the actual pressure in the air-bag 331 linearly.

This embodiment is to calibrate the relationship between the value of the pressure command value Pin and the actual pressure in the air-bag 331, and the relationship between the value of the pressure read value Prd and the actual pressure in the air-bag 331.

Figure 3:
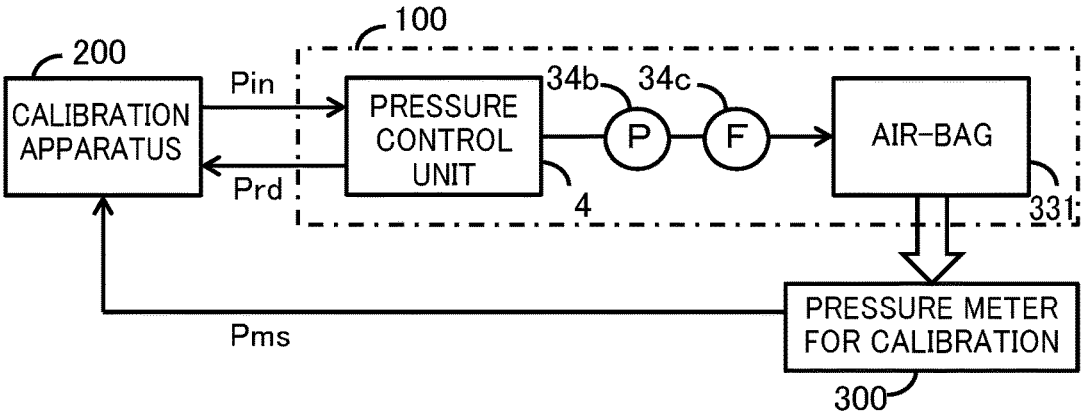
FIG. 3 is a block diagram schematically showing the configuration of a calibration system according to a first embodiment.

FIG. 3 is a block diagram schematically showing the configuration of a calibration system according to the first embodiment. In the example described below, calibration is performed mainly on the air-bag 331. In order to calibrate the substrate polishing apparatus 100, a calibration apparatus 200 and a pressure meter 300 for calibration are used.

The pressure meter 300 for calibration is attached to the air-bag 331 to be calibrated, and measures the pressure in the air-bag 331. The pressure meter 300 for calibration then transmits a pressure measurement value Pms to the calibration apparatus 200 via an RS-232C cable, for example. The pressure measurement value Pms can be regarded as the actual pressure in the air-bag 331.

The calibration apparatus 200 inputs a pressure command value Pin to the pressure control unit 4 of the substrate polishing apparatus 100, and also receives a pressure read value Prd from the pressure control unit 4 and a pressure measurement value Pms from the pressure meter 300 for calibration. Based on these values, the calibration apparatus 200 performs calibration.

Figure 4:
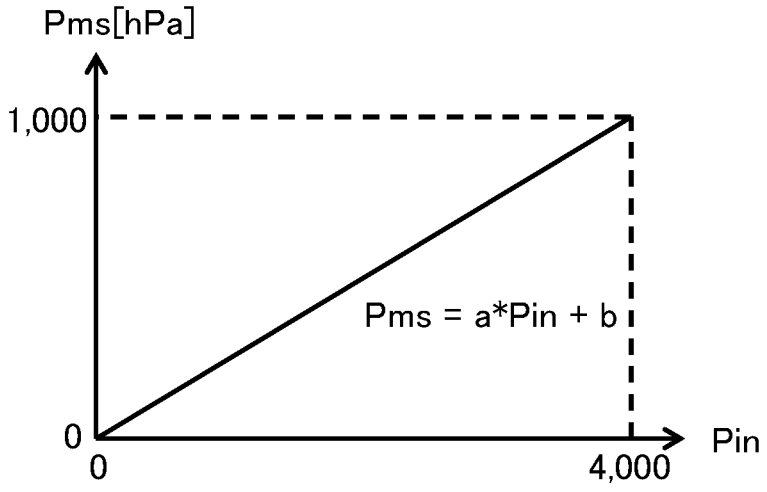
FIG. 4 is a graph schematically showing the relationship between pressure command values and pressure measurement values.

FIG. 4 is a graph schematically showing the relationship between the pressure command value Pin and the pressure measurement value Pms. As mentioned above, the pressure command value Pin is a target value for the air-bag 331, and linearly corresponds to the pressure measurement value Pms. The relationship between the two values is expressed by the equation (1) shown below.

$$Pms=a*Pin+b \quad (1)$$

For example, the substrate polishing apparatus 100 is designed so that pressure command values Pin from 0 to 4000 correspond to pressure measurement values Pms from 0 to 1000 hPa. In this case, a=0.25, and b=0. In reality, however, a is not necessarily 0.25, and b is not necessarily 0, because there might be changes over time or the like. To counter this, in the calibration according to this embodiment, the constants a and b, which define the relationship between the pressure command value Pin and the actual pressure in the air-bag 331, are determined. Here, the pressure command value Pin is a digital value, and the pressure in the air-bag 331 is an analog value. Therefore, the constants a and b can be also referred to as the D/A parameters.

Figure 5:
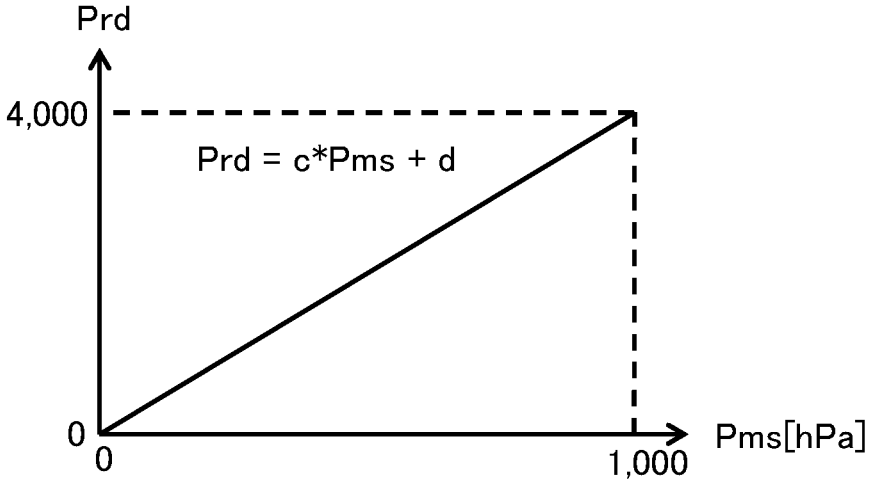
FIG. 5 is a graph schematically showing the relationship between pressure measurement values and pressure read values.

FIG. 5 is a graph schematically showing the relationship between the pressure measurement value Pms and the pressure read value Prd. As mentioned above, the pressure read value Prd corresponds to the actual pressure in the air-bag 331, and has a linear relationship to the pressure measurement value Pms. The relationship between the two values is expressed by the equation (2) shown below.

$$Prd=c*Pms+d \quad (2)$$

For example, the substrate polishing apparatus 100 is designed so that pressure measurement values Pms from 0 to 1000 hPa correspond to pressure read values Prd from 0 to 4000. In this case, c=4, and d=0. In reality, however, c is not necessarily 4, and d is not necessarily 0, because there might be changes over time or the like. To counter this, in the calibration according to this embodiment, the constants c and d, which define the relationship between the pressure measurement value Pms (namely the actual pressure) and the pressure read value Prd, are determined. Here, the actual pressure in the air-bag 331 is an analog value, and the pressure read value Prd is a digital value. Therefore, the constants c and d can be also referred to as the A/D parameters.

That is, the calibration apparatus 200 shown in FIG. 3 determines the D/A parameters a and b, and the A/D parameters c and d.

Figure 6:
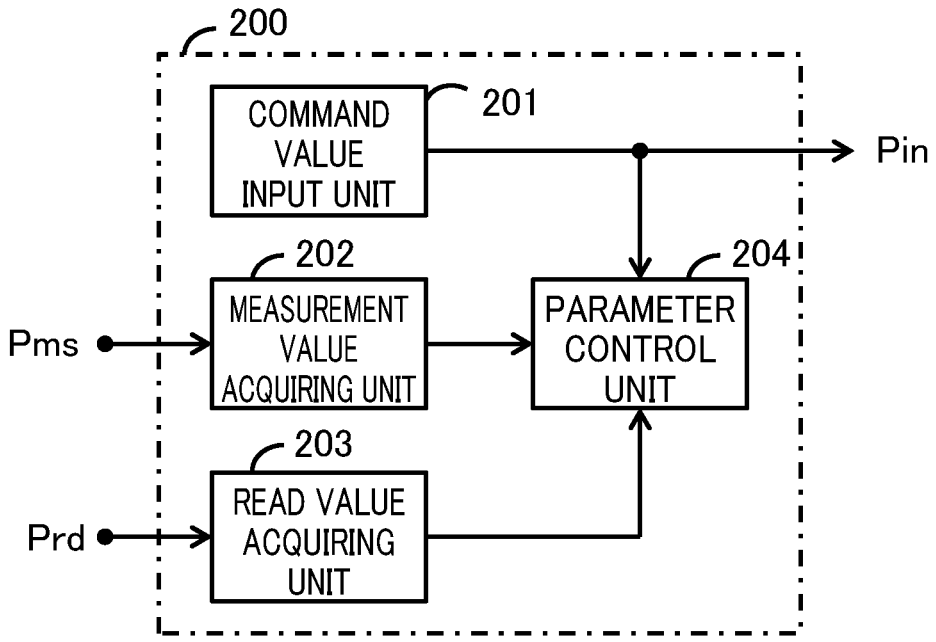
FIG. 6 is a block diagram schematically showing the configuration of a calibration apparatus according to the first embodiment.

FIG. 6 is a block diagram schematically showing the configuration of the calibration apparatus 200 according to the first embodiment. The calibration apparatus 200 includes a command value input unit 201, a measurement value acquiring unit 202, a read value acquiring unit 203, and a parameter control unit 204. The calibration apparatus 200 may be computer, for example, and its processor executes a certain program so that the computer functions as these units.

The command value input unit 201 generates a pressure command value Pin, and inputs the pressure command value Pin to the pressure control unit 4 of the substrate polishing apparatus 100. More specifically, the command value input unit 201 sequentially inputs pressure command values Pin to the pressure control unit 4.

Every time a pressure command value Pin is input to the pressure control unit 4, the measurement value acquiring unit 202 acquires the pressure measurement value Pms of the air-bag 331 measured by the pressure meter 300 for calibration.

Every time a pressure command value Pin is input to the pressure control unit 4, the read value acquiring unit 203 acquires the pressure read value Prd of the air-bag 331 that has been measured by the pressure meter 34*b* and been output from the pressure control unit 4.

In accordance with the pressure command value Pin, the pressure measurement value Pms, and the pressure read value Prd, the parameter control unit 204 determines the parameters a through d. Specifically, the parameter control unit 204 determines whether the initial values of the parameters a through d are appropriate, and, if the initial values are not appropriate, calculates appropriate parameters a through d.

Figure 7:
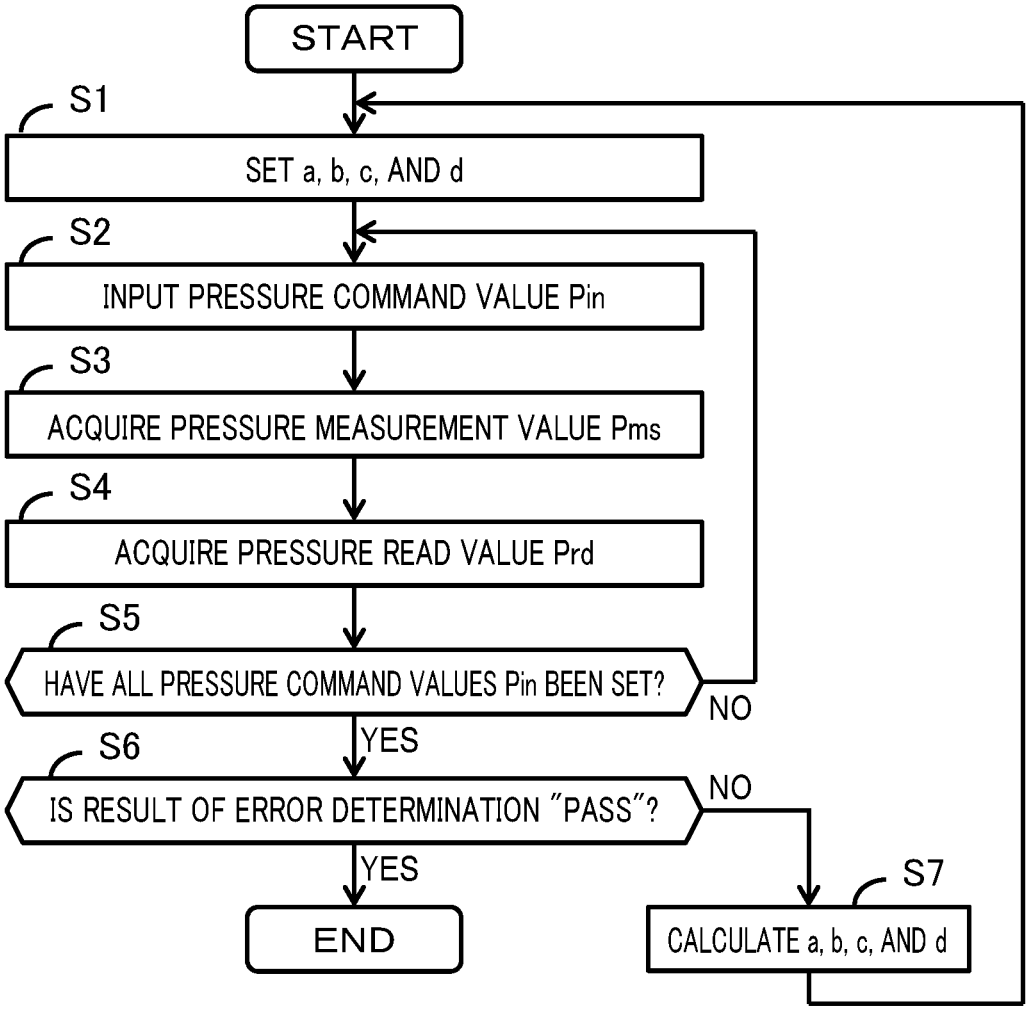
FIG. 7 is a flowchart showing a processing operation to be performed by the calibration apparatus according to the first embodiment.

FIG. 7 is a flowchart showing a processing operation to be performed by the calibration apparatus 200 according to the first embodiment. It should be noted that the air-bag to be calibrated and the pressure meter 34*b* need to be connected to each other in advance. In a case where the air-bag 331 is to be calibrated, for example, only the valve 341*a* shown in FIG. 2 is opened so that the pressure meter 34*b* can measure the pressure in the air-bag 331. Also, the pressure meter 300 for calibration is attached to the air-bag 331 to be calibrated so that the pressure in the air-bag 331 can be measured.

First, the initial values of the parameters a through d are set in the parameter control unit 204 (step S1). In the above described example, a=0.25, b=0, c=4, and d=0.

The command value input unit 201 then inputs a certain pressure command value Pin (step S2). The first pressure command value Pin is 0, for example. In accordance with this pressure command value Pin, the pressure control unit 4 adjusts the pressure in the air-bag 331.

The measurement value acquiring unit 202 then acquires a pressure measurement value Pms from the pressure meter 300 for calibration (step S3), and the read value acquiring unit 203 acquires a pressure read value Prd that has been obtained by the pressure meter 34*b* and been output from the pressure control unit 4 (step S4). Steps S3 and S4 may be carried out at the same time, or one of the steps may be carried out before the other. The acquired pressure measurement value Pms and pressure read value Prd are associated with the pressure command value Pin at this time, and are then stored.

As pressure command values Pin are sequentially changed (for example, as the pressure command value Pin is incremented by 400 at a time), steps S2 through S4 are repeated (step S5).

Using the pressure command values Pin, the pressure measurement values Pms, the pressure read values Prd, and the parameters a through d obtained in the above manner, the parameter control unit 204 performs error determination for the D/A parameters and error determination for the A/D parameters (step S6).

FIGS. 8A and 8B are tables for explaining the error determination for the D/A parameters. FIGS. 8A and 8B show relationships between pressure command values Pin input to the pressure control unit 4 and pressure measurement values Pms obtained through measurement carried out by the pressure meter 300 for calibration. Also, a=0.25 and b=0 are set as initial values, and relationships between the pressure command values Pin and the pressure calculated values Pcalc (=0.25Pin) in this case are also shown in FIGS. 8A and 8B.

In FIG. 8A, the pressure measurement values Pms are almost the same as the pressure calculated values Pcalc. In this case, the result of the error determination indicates "pass". In FIG. 8B, on the other hand, the pressure measurement values Pms greatly differ from the pressure calculated values Pcalc. In this case, the result of the error determination indicates "fail".

As for a specific example criterion for error determination, "pass" may be issued in a case where all the differences between the pressure measurement values Pms and the corresponding pressure calculated values Pcalc are not larger than a predetermined threshold value.

FIGS. 9A and 9B are tables for explaining the error determination for the A/D parameters. FIGS. 9A and 9B show relationships between pressure measurement values Pms obtained through measurement carried out by the pressure meter 300 for calibration and pressure read values Prd output from the pressure control unit 4. Also, c=4 and d=0 are set as initial values, and relationships between the pressure measurement values Pms and the pressure calculated values Pcalc (=4Pms) in this case are also shown in FIGS. 9A and 9B.

In FIG. 9A, the pressure read values Prd are almost the same as the pressure calculated values Pcalc. In this case, the result of the error determination indicates "pass". In FIG. 9B, on the other hand, the pressure read values Prd greatly differ from the pressure calculated values Pcalc. In this case, the result of the error determination indicates "fail".

As for a specific example criterion for error determination, "pass" may be issued in a case where all the differences between the pressure read values Prd and the corresponding pressure calculated values Pcalc are not larger than a predetermined threshold value.

Referring back to FIG. 7, in a case where at least one of the results of the error determination for the D/A parameters and the error determination for the A/D parameters indicates "fail" (NO in step S6), the parameter control unit 204 calculates the parameters (step S7).

Specifically, in a case where the result of the error determination for the D/A parameters indicates "fail", the D/A parameters a and b are calculated by applying the least-square method, for example, to the relationship between the pressure command values Pin and the pressure measurement values Pms. In the example shown in FIG. 8B, a=0.2 and b=150 are obtained.

In a case where the result of the error determination for the A/D parameters indicates "fail", the A/D parameters c and d are calculated by applying the least-square method, for example, to the relationship between the pressure measurement values Pms and the pressure read values Prd. In the example shown in FIG. 9B, c=3.3 and d=33 are obtained.

The new parameters a through d are then set (step S1 in FIG. 7), and the same procedures as above are repeated.

In a case where the results of the error determination for the D/A parameters and the error determination for the A/D parameters both indicates "pass" ("YES" in step S6), on the other hand, the parameters a through d at this point of time remain as they are, and the calibration of the air-bag 331 is ended. To perform calibration with even higher precision, it is also possible to calculate the parameters a through d by the least-square method or the like in this case.

After an air-bag is calibrated, namely after the parameters a through d are determined, the next air-bag is calibrated.

As described above, according to the first embodiment, the calibration apparatus 200 acquires pressure measurement values Pms and pressure read values Prd while changing pressure command values Pin, and determines the parameters a through d by performing error determination and calculating the parameters a through din accordance the acquired values. Thus, the tasks the operator needs to carry out can be reduced, and the substrate polishing apparatus 100 can be efficiently calibrated in a simple manner.

Second Embodiment

In the substrate polishing apparatus 100 described in the first embodiment, there might be small amounts of leakage from the air-bags 331 through 338 and the pipes 341 through 348. To counter this, the second embodiment described below concerns leakage error detection during calibration. In the description below, the differences from the first embodiment will be mainly explained.

Figure 10:
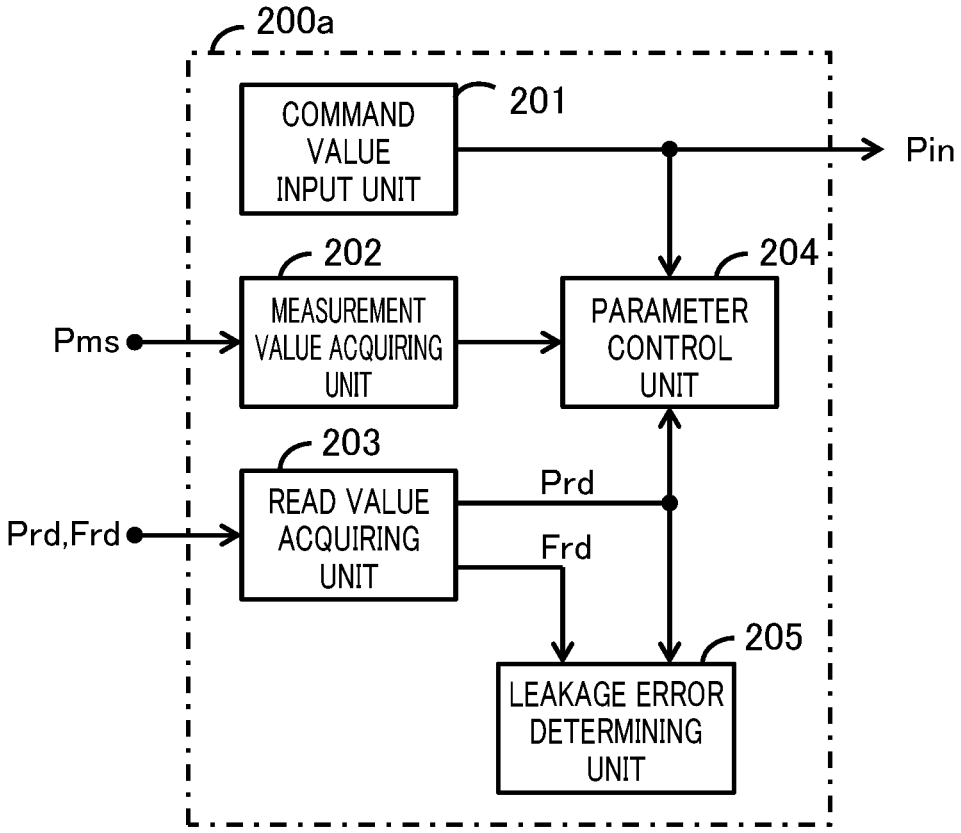
FIG. 10 is a block diagram schematically showing the configuration of a calibration apparatus according to a second embodiment.

FIG. 10 is a block diagram schematically showing the configuration of a calibration apparatus 200*a* according to the second embodiment. The read value acquiring unit 203 shown in FIG. 10 acquires a flow rate read value Frd of the flowmeter 34*c* (see FIG. 3), as well as a pressure read value Prd, from the pressure control unit 4. The flow rate read value Frd indicates the rate of flow into/from the air-bag to be calibrated.

The calibration apparatus 200*a* further includes a leakage error determining unit 205. In accordance with the pressure read value Prd and the flow rate read value Frd, the leakage error determining unit 205 determines whether there is a leakage error in the air-bag to be calibrated.

Figure 11:
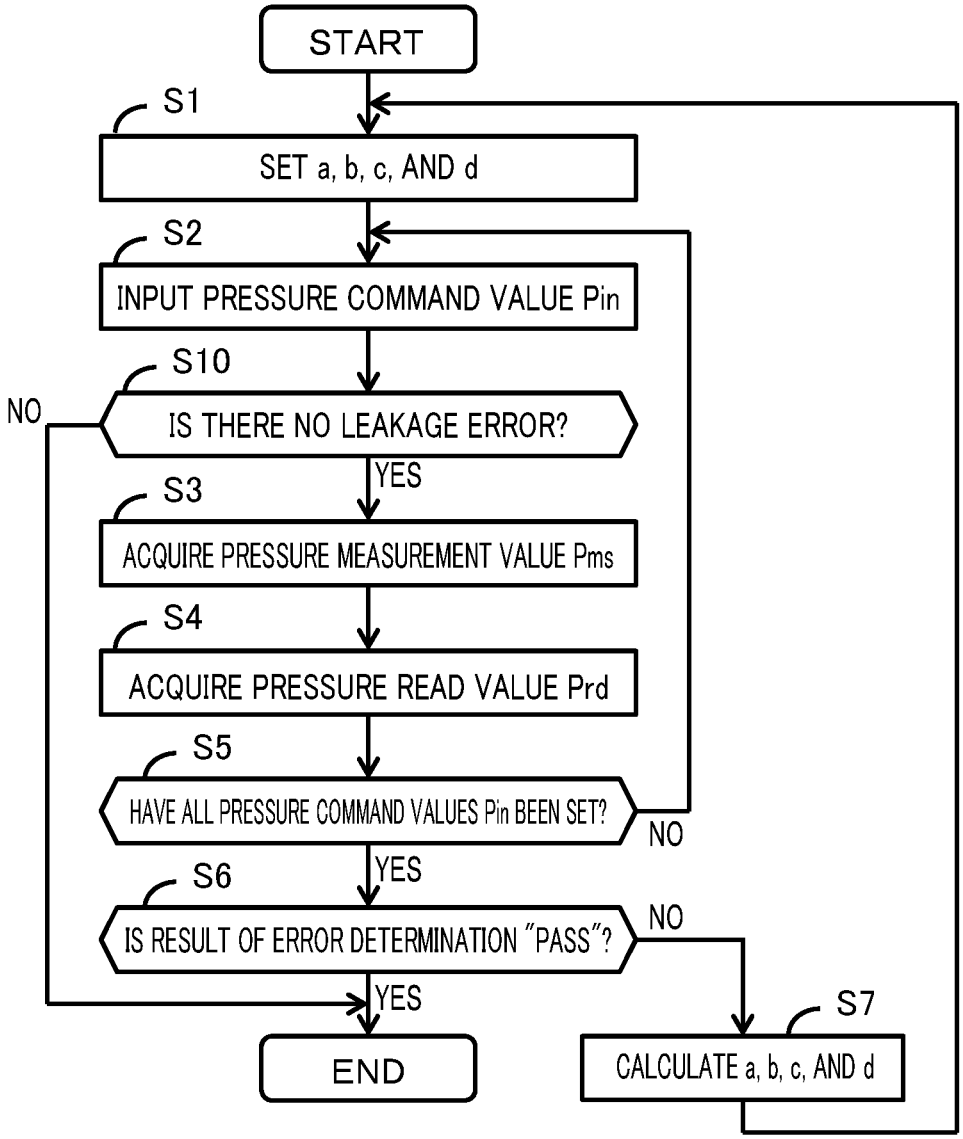
FIG. 11 is a flowchart showing a processing operation to be performed by the calibration apparatus according to the second embodiment.

FIG. 11 is a flowchart showing a processing operation to be performed by the calibration apparatus 200*a* according to the second embodiment. In this embodiment, after the command value input unit 201 inputs a pressure command value Pin, or after step S2, the leakage error determining unit 205 determines whether there is a leakage error (step S10). In the description below, the leakage error determination will be explained in detail.

Figure 12:
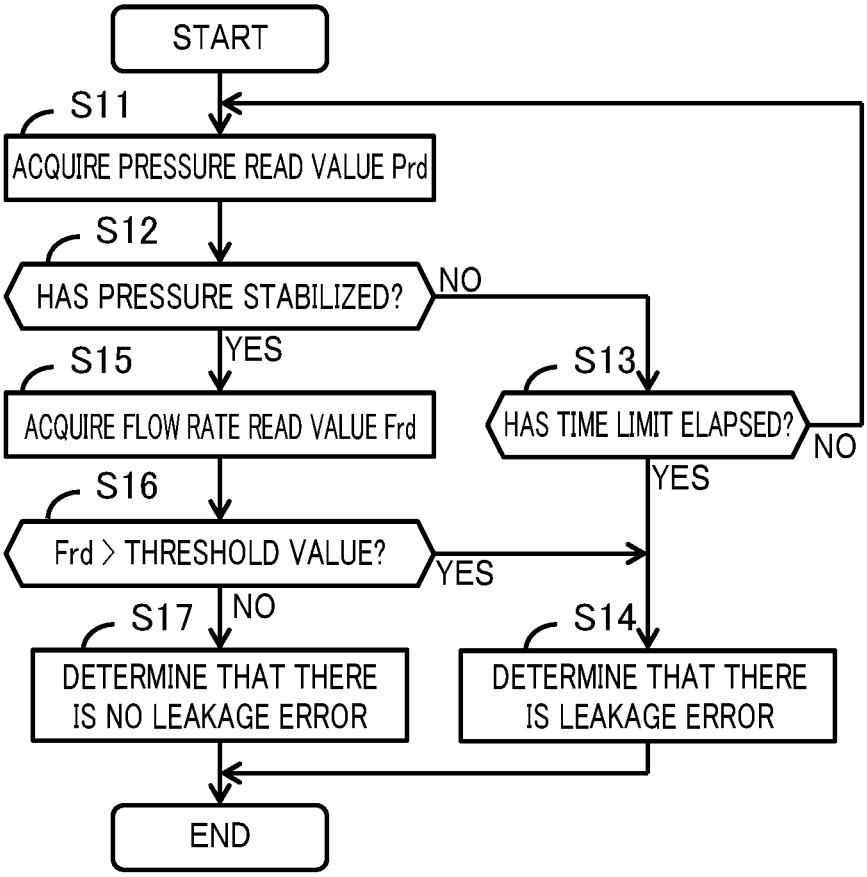
FIG. 12 is a flowchart showing a processing operation to be performed by the calibration apparatus according to the second embodiment.

FIG. 12 is a flowchart showing the procedures in the leakage error determination. The read value acquiring unit 203 acquires a pressure read value Prd (step S11). Using the pressure read value Prd, the leakage error determining unit 205 determines whether the pressure in the air-bag to be calibrated has stabilized (step S12).

Figure 13:
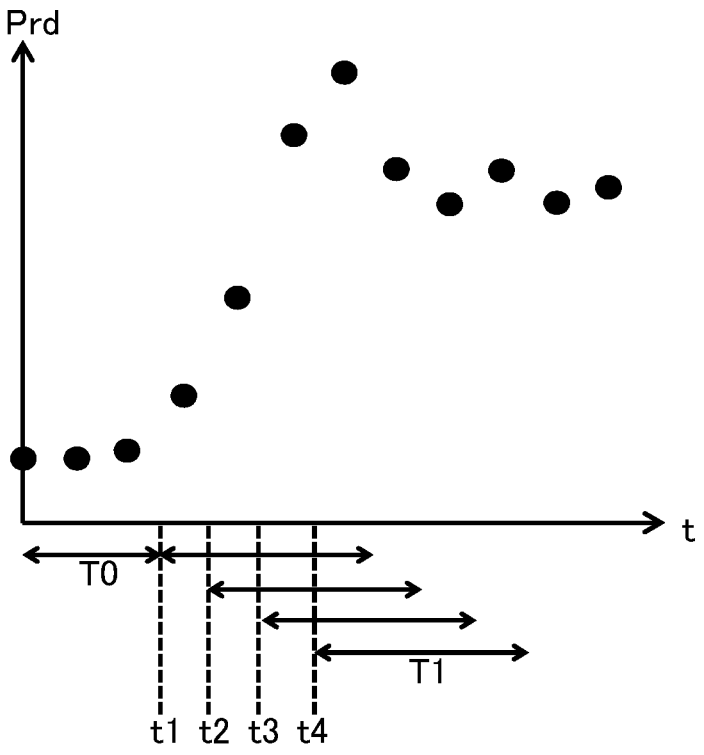
FIG. 13 is a graph for explaining a method of determining pressure stabilization.

FIG. 13 is a graph for explaining a method of determining pressure stabilization. In this graph, the horizontal axis indicates time, and the vertical axis indicates pressure read values Prd.

The leakage error determining unit 205 does not perform pressure stabilization determination for a certain period of time T0 after the pressure control unit 4 starts performing pressure control (pressurization, for example) on the air-bag to be calibrated.

During a predetermined sampling period T1 from time t1, at which the certain period of time T0 has passed, the leakage error determining unit 205 samples pressure read values Prd, to form a sample group. If the difference between the largest pressure read value Prd and the smallest pressure read value Prd in the sample group is within a certain range, the leakage error determining unit 205 determines that the pressure in the air-bag to be calibrated has stabilized. If the difference is beyond the certain range, the leakage error determining unit 205 determines that the pressure in the air-bag to be calibrated has not stabilized.

If the pressure has not stabilized, the same determination is performed on the sample group during the sampling period T1 from time t2, at which a predetermined time has passed since time t1.

It should be noted that the sampling period T1, the range for determining whether the pressure has stabilized, and the number of samples (the number of pressure read values Prd) in each sample group can be set by a user.

Referring back to FIG. 12, if the pressure does not stabilize even after a predetermined time has passed, and the time limit has elapsed, (NO in step S12, and step S13), the leakage error determining unit 205 determines that there is a leakage error (step S14). This is because the likelihood of leakage from the air-bag to be calibrated is high in a case where the pressure does not stabilize over a long period of time.

After the pressure has stabilized (YES in step S12), the read value acquiring unit 203 acquires a flow rate read value Frd (step S15). The leakage error determining unit 205 then compares the flow rate read value Frd with a predetermined threshold value (50 ml/min, for example), to determine whether there is a leakage error (step S16).

That is, if the flow rate read value Frd is greater than the threshold value (YES in step S16), the leakage error determining unit 205 determines that there is a leakage error (step S14). This is because the pressure in the air-bag to be calibrated has stabilized after continuous air flow into the air-bag, and the likelihood of leakage from the air-bag is high.

If the flow rate read value Frd is not greater than the threshold value (NO in step S16), on the other hand, the leakage error determining unit 205 determines that there is no leakage error (step S17).

Referring back to FIG. 11, if there is no leakage error (YES in step S10), the same procedures as those in the first embodiment are carried out in step S3 and later.

If there is a leakage error (NO in step S10), on the other hand, the process of calibrating the air-bag is ended.

As described above, according to the second embodiment, a check is made to determine whether there is leakage from the air-bag to be calibrated. Thus, leakage can be detected during a calibration process.

Third Embodiment

According to the third embodiment described below, a reliability test is carried out after the parameters a through d are determined, to increase calibration accuracy. In the description below, the differences from the first embodiment will be mainly explained. A calibration apparatus 200 according to this embodiment has the same configuration as that of the first embodiment shown in FIG. 6.

Figure 14:
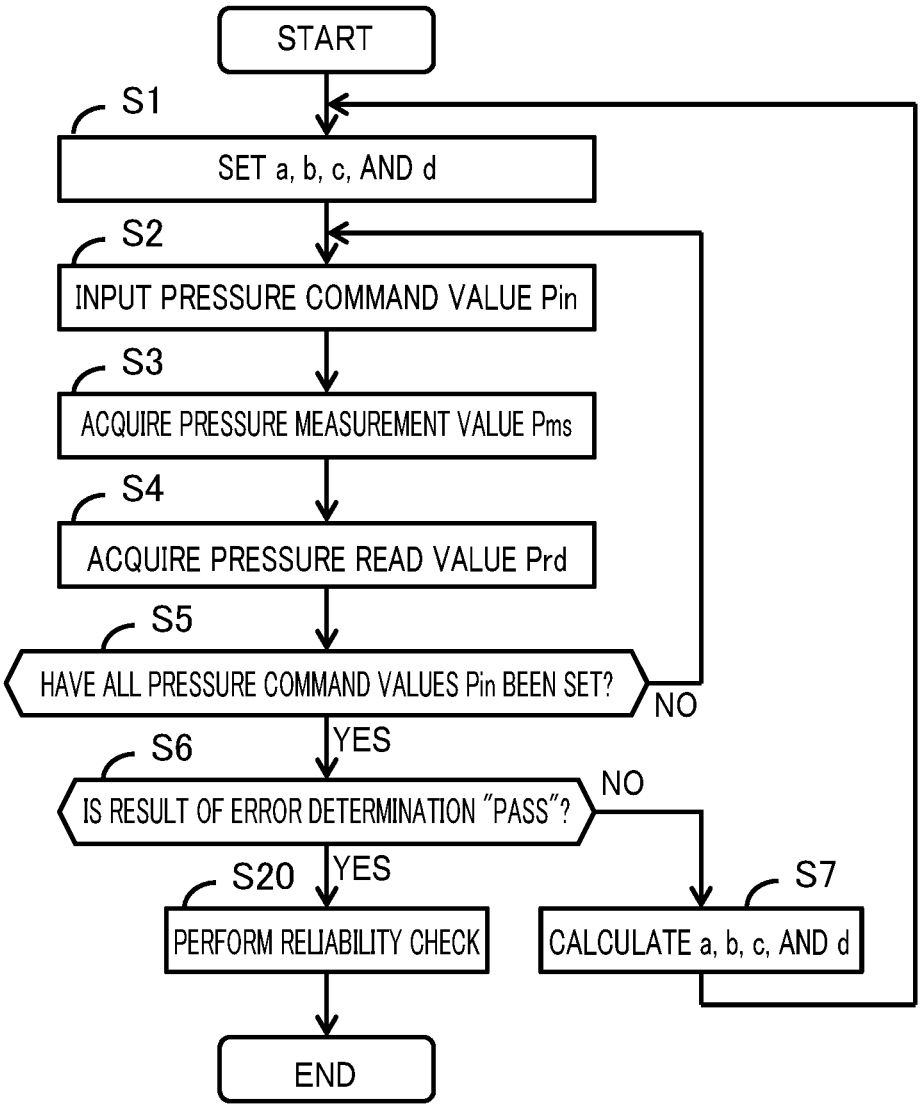
FIG. 14 is a flowchart showing a processing operation to be performed by a calibration apparatus according to a third embodiment.

FIG. 14 is a flowchart showing a processing operation to be performed by the calibration apparatus 200 according to the third embodiment. In this embodiment, after the result of the error determination is "pass" (YES in step S6), the parameter control unit 204 of the calibration apparatus 200 performs a reliability check (step S20). As for the procedures in the reliability check, pressure measurement values Pms and pressure read values Prd are acquired while pressure command values Pin are changed as in steps S2 through S5, and the same error determination as in step S6 is performed with the use of the determined parameters a through d.

Specifically, the parameter control unit 204 determines whether the relationships among the pressure command values Pin, the pressure measurement values Pms, and the D/A parameters a and b are appropriate, and also determines whether the relationships among the pressure measurement values Pms, the pressure read values Prd, and the A/D parameters c and d are appropriate.

As described above, a reliability check is performed in the third embodiment. Thus, the repetitive accuracy of the parameters a through d can be checked.

A reliability check may also be performed in the second embodiment in which leakage error determination is performed.

Fourth Embodiment

In the above described first through third embodiments, calibration is performed on the pressures in the air-bags 331 through 338. The fourth embodiment described below concerns calibration of the load on a dresser.

Referring again to FIG. 1, a substrate polishing apparatus 100 of this embodiment includes a dressing unit 5, a dressing liquid supply nozzle 6 that supplies a dressing liquid (such as pure water) at the time of dressing, and a load control unit 7. The dressing unit 5 is formed with a dresser 51, a dresser shaft 52, a pressing mechanism 53, and the like.

The dresser 51 is circular in cross-section, and the lower surface of the dresser 51 is the dressing surface. The dressing surface is formed with a dressing disk 51*a* to which diamond particles or the like adhere. The dresser 51 brings the dressing disk 51*a* into contact with the polishing pad 1*a*, and scrapes the dressing disk 51*a* against the surface of the polishing pad 1*a*, to dress (roughen) the surface of the polishing pad 1*a*.

The dresser 51 is joined to the lower end of the dresser shaft 52, and the upper end of the dresser shaft 52 is joined to the pressing mechanism 53. The dresser shaft 52 has a load cell 52*a* that measures the load applied to the dresser shaft 52. The load applied to the dresser shaft 52 corresponds to the load applied to the dresser 51.

The pressing mechanism 53 is designed to lift up and down the dresser shaft 52. As the dresser shaft 52 is lowered, the dresser 51 is pressed against the polishing pad 1*a*. As a specific example, the pressing mechanism 53 includes an electropneumatic regulator 531 that generates a predetermined pressure, and a cylinder 532 that is attached to an upper portion of the dresser shaft 52 and lifts up and down the dresser shaft 52 with the generated pressure.

By adjusting the pressure to be generated by the electropneumatic regulator 531, the load control unit 7 controls the load to be applied to the dresser shaft 52, namely the load to be applied to the polishing pad 1*a* by the dresser 51. Specifically, a load command value Lin for controlling the load is input to the load control unit 7 from outside. As the load control unit 7 adjusts the pressure to be generated by the electropneumatic regulator 531 in accordance with the load command value Lin, the load to be applied to the dresser shaft 52 is controlled.

The load control unit 7 also reads the value of the load cell 52*a*, and outputs the value as a load read value Lrd. The load read value Lrd corresponds to the actual load on the dresser 51.

Figure 15:
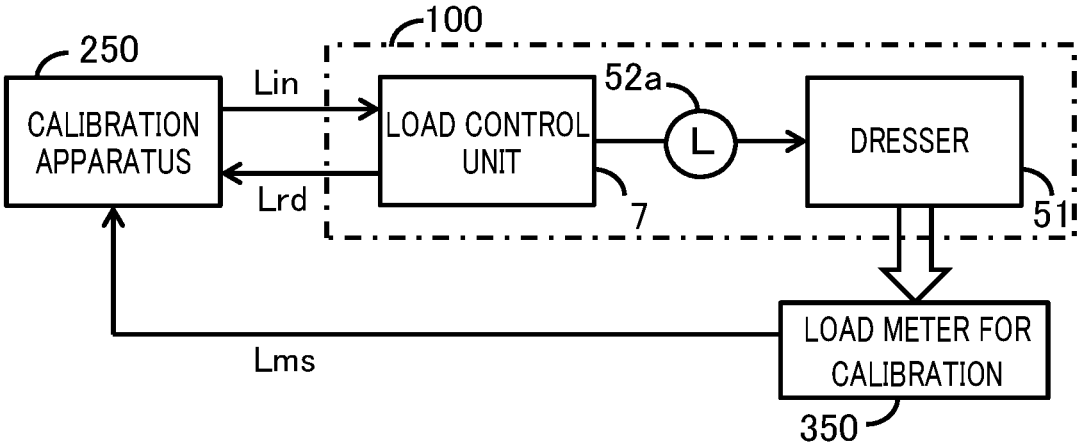
FIG. 15 is a block diagram schematically showing the configuration of a calibration system according to a fourth embodiment.

FIG. 15 is a block diagram schematically showing the configuration of a calibration system according to the fourth embodiment. In calibrating the substrate polishing apparatus 100, a calibration apparatus 250 and a load meter 350 for calibration are used.

The load meter 350 for calibration is attached to the dresser 51, and measures the load thereon. The load meter 350 for calibration then transmits a load measurement value Lms to the calibration apparatus 250 via an RS-232C cable, for example. The load measurement value Lms can be regarded as the actual load to be applied to the dresser 51.

The calibration apparatus 250 inputs a load command value Lin to the load control unit 7 of the substrate polishing apparatus 100, and also receives a load read value Lrd from the load control unit 7 and a load measurement value Lms from the load meter 350 for calibration. In accordance with these values, the calibration apparatus 250 performs calibration.

A specific calibration method according to this embodiment is the same as the method according to the first embodiment, except that the pressure control unit 4, the pressure meter 34*b*, the air-bag to be calibrated, and the pressure meter 300 for calibration are replaced with the load control unit 7, the load cell 52*a*, the dresser 51, and the load meter 350 for calibration, respectively.

By installing a flowmeter at an appropriate site (on the dresser shaft 52, for example), leakage error determination can be performed between the cylinder 532 and the dresser 51 in the same manner as in the second embodiment. Further, a reliability check may be performed as in the third embodiment.

The above embodiments are disclosed for enabling those with ordinary knowledge in the technical field of the present invention to carry out the present invention. Various modifications of the above embodiments should be obvious to those skilled in the art, and the technical ideas of the present invention can be applied to other embodiments. Therefore, the present invention is not limited to the above embodiments, and should be construed as including a wider technical scope based on the technical ideas defined by the claims.

The invention claimed is:

1. A method of calibrating a relationship among a pressure command value, a pressure in an air-bag, and a pressure read value of the air-bag in a substrate polishing apparatus, the substrate polishing apparatus comprising:

a polishing table;

the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag, the method comprising:

sequentially inputting a plurality of pressure command values to the pressure control unit;

acquiring a pressure measurement value of the air-bag with respect to each of the pressure command values, the pressure measurement value being measured by a pressure meter for calibration;

acquiring, from the pressure control unit, a pressure read value of the air-bag with respect to each of the pressure command values; and determining a first parameter and a second parameter, the first parameter indicating a relationship between the pressure command value and the pressure measurement value, and the second parameter indicating a relationship between the pressure measurement value and the pressure read value.

2. The method according to claim 1, further comprising determining, after the pressure command value is input to the pressure control unit, whether there is leakage from the air-bag.

3. The method according to claim 2, wherein determining whether there is leakage from the air-bag comprises:

determining whether the pressure in the air-bag has stabilized; and determining that there is leakage from the air-bag when the pressure in the air-bag does not stabilize over a predetermined period of time.

4. The method according to claim 2, wherein determining whether there is leakage from the air-bag comprises:

determining whether the pressure in the air-bag has stabilized; and determining that there is leakage from the air-bag when a rate of flow into or from the air-bag exceeds a first value after the pressure in the air-bag has stabilized.

5. The method according to claim 3, wherein determining whether the pressure in the air-bag has stabilized is carried out after a first period of time has passed since the pressure control unit started controlling the pressure in the air-bag in accordance with the pressure command value.

6. The method according to claim 3, wherein determining whether the pressure in the air-bag has stabilized comprises;

acquiring the pressure read value for a first period of time, and determining whether the pressure has stabilized in accordance with a difference between a largest value of the pressure read value and a smallest value of the pressure read value during the first period of time.

7. The method according to claim 1, wherein after the first parameter and the second parameter are generated, inputting the plurality of pressure command values, acquiring the pressure measurement value and acquiring the pressure read value are carried out; and the method further comprises checking whether a first relationship among the pressure command value, the pressure measurement value and the generated first parameter is appropriate, and checking whether a second relationship among the pressure measurement value, the pressure read value and the generated second parameter is appropriate.

8. A calibration apparatus that calibrates a relationship among a pressure command value, a pressure in an air-bag, and a pressure read value of the air-bag in a substrate polishing apparatus, the substrate polishing apparatus comprising:

a polishing table;

the air-bag configured to press a substrate against the polishing table, the pressure for pressing the substrate being variable; and a pressure control unit configured to control the pressure in the air-bag in accordance with the pressure command value input to the pressure control unit, and read the pressure in the air-bag, the calibration apparatus comprising:

a command value input unit configured to sequentially input a plurality of pressure command values to the pressure control unit;

a measurement value acquiring unit configured to acquire a pressure measurement value of the air-bag with respect to each of the pressure command values, the pressure measurement value being measured by a pressure meter for calibration;

a read value acquiring unit configured to acquire, from the pressure control unit, a pressure read value of the air-bag with respect to each of the pressure command values; and a parameter control unit configured to determine a first parameter and a second parameter, the first parameter indicating a relationship between the pressure command value and the pressure measurement value, and the second parameter indicating a relationship between the pressure measurement value and the pressure read value.

9. A non-transitory computer readable recording medium for recording a calibration program of calibrating a relationship among a pressure command value, a pressure in an air-bag, and a pressure read value of the air-bag in a substrate polishing apparatus, the substrate polishing apparatus comprising:

a polishing table;

the air-bag configured to press a substrate against the polishing table, the pressure for pressing the substrate being variable; and a pressure control unit configured to control the pressure in the air-bag in accordance with the pressure command value inputted to the pressure control unit, and read the pressure in the air-bag, the calibration program causing a computer to execute:

sequentially inputting a plurality of pressure command values to the pressure control unit;

acquiring a pressure measurement value of the air-bag with respect to each of the pressure command values, the pressure measurement value being measured by a pressure meter for calibration;

acquiring, from the pressure control unit, a pressure read value of the air-bag with respect to each of the pressure command values; and determining a first parameter and a second parameter, the first parameter indicating a relationship between the pressure command value and the pressure measurement value, and the second parameter indicating a relationship between the pressure measurement value and the pressure read value.

* * * * *